United States Patent [19]

Stewart

[11] Patent Number: 5,058,875

[45] Date of Patent: Oct. 22, 1991

[54] CURRENCY COUNTER

[75] Inventor: Robert M. Stewart, Langhore, Pa.

[73] Assignee: Brandt, Inc., Bensalem, Pa.

[21] Appl. No.: 545,372

[22] Filed: Jun. 28, 1990

[51] Int. Cl.[5] ..... B65H 3/34

[52] U.S. Cl. ..... 271/10; 271/124; 271/270

[58] Field of Search ..... 271/124, 125, 270, 161, 271/10

[56] References Cited

U.S. PATENT DOCUMENTS

| | | | |
|---|---|---|---|
| 2,080,968 | 5/1937 | Krell | 271/124 |
| 2,233,153 | 2/1941 | Welk | 271/124 |
| 4,443,006 | 4/1984 | Hasegawa | 271/124 X |
| 4,474,365 | 10/1984 | DiBlasio | 271/270 X |
| 4,615,518 | 10/1986 | DiBlasio | 271/270 X |

*Primary Examiner*—Richard A. Schacher
*Attorney, Agent, or Firm*—Shenier & O'Connor

[57] ABSTRACT

A sheet feeder in which a cam member shiftable transversely of the sheet feed path provides concomitant adjustment relative to the feed rollers of stripper shoes carried by resilient arms integral with stripper supports mounted for movement as a unit relative to the feed rollers and in which elements on the supports adjust the positions of the resilient arms for individual adjsutment of the shoes. A rib on a curved guide adjacent to the feed rollers prevents snapping of sheets against the feed rollers as they are picked up by an accelerating nip formed adjacent to the end of the guide by a pair of acceleration rollers, one of which is formed with a groove for accommodating the nip.

29 Claims, 2 Drawing Sheets

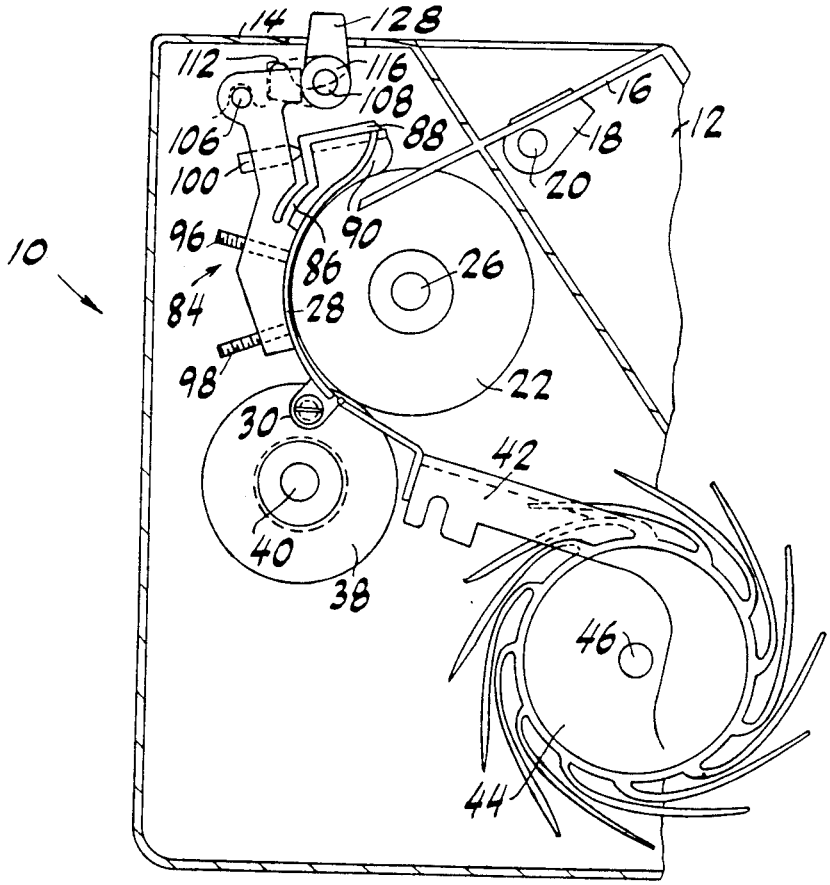
FIG. 1
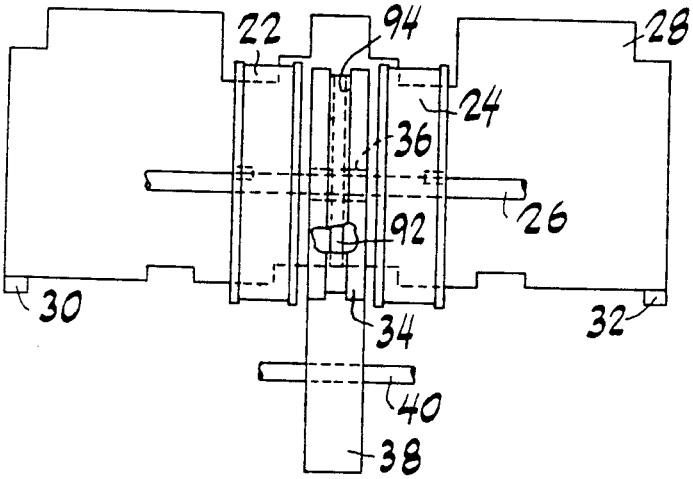
FIG. 2
FIG. 5
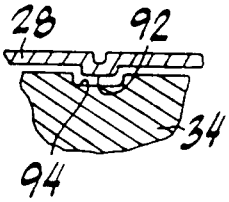
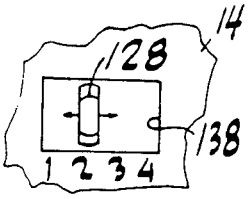
FIG. 8

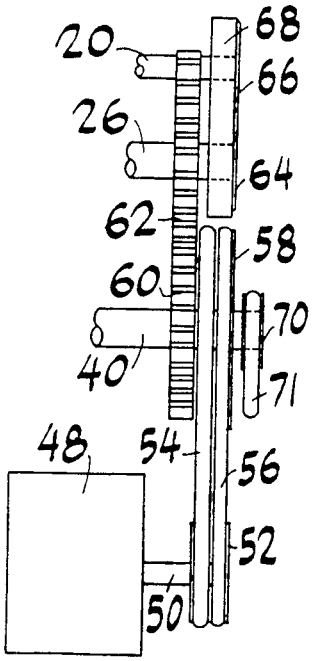
FIG. 3
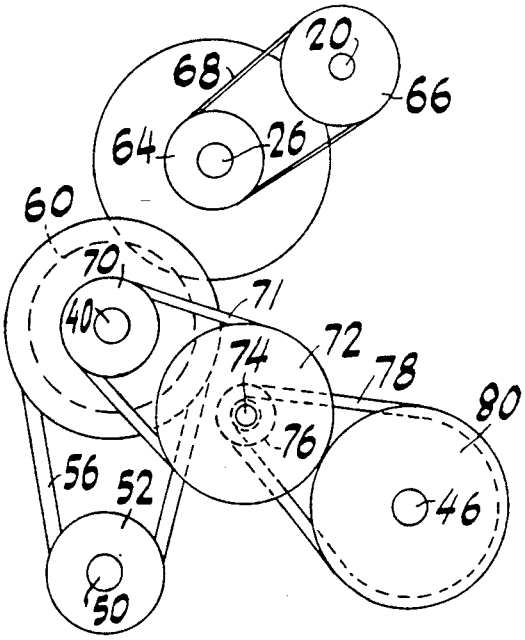
FIG. 4
FIG. 7
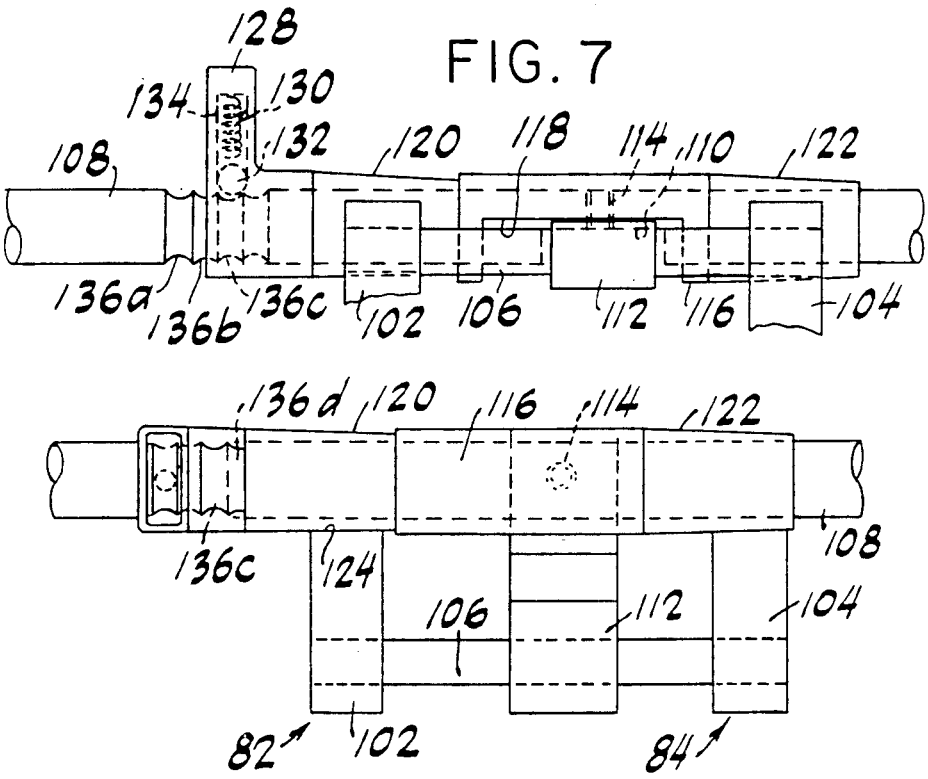
FIG. 6

CURRENCY COUNTER

FIELD OF THE INVENTION

The invention is in the field of sheet handling apparatus and, more particularly, the field of high speed currency counters.

BACKGROUND OF THE INVENTION

There are known in the prior art various forms of sheet handling devices which are adapted, for example, to count sheets of currency or the like at a high rate of speed. One such device is shown in DiBlasio U.S. Pat. No. 4,474,365 issued Oct. 2, 1984. In the arrangement shown in this patent, sheets of currency or the like are removed from the bottom of the stack and fed one by one by means of feed rollers and cooperating stripper shoes along a curved path formed by a curved guide mounted adjacent to the feed rollers. An idling accelerating roller which is coaxial with the feed rollers and a driven accelerator roller form a nip adjacent to the lower end of the curved guide for receiving advancing sheets and feeding them to a stacker or the like.

In operation of the apparatus described above, under the action of the feed rollers and strippers sheets being advanced are pushed against the curved guide as they advance toward the accelerating roller nip. When the sheets are picked up by the accelerating rollers, they are snapped against the feed rollers, producing a popping noise which at high speeds of operation is both annoying and distracting.

In the arrangement shown in the DiBlasio patent, the stripper shoes associated with the respective feed rollers are mounted on arms pivoted around a common shaft. One end of a latch spring is secured to a shaft on the frame and the other end engages a rod connecting the two stripper support arms to urge the stripper shoes toward the feed rolls. The frame-carried shaft has eccentric cam surfaces which are engaged by set screws on the stripper arms. Rotation of the shaft provides concomitant adjustment of both of the stripper shoes relative to their respective feed rolls. The set screws provide individual adjustment of the stripper shoes. While the stripper shoe adjustment just described is generally satisfactory, it is not as precise as is desirable. It is essentially a trial and error adjustment rather than a predetermined adjustment. It suffers from the additional disadvantage that it requires the cover of the machine to be removed for adjustment.

SUMMARY OF THE INVENTION

One object of my invention is to provide an improved currency counter which overcomes the defects of currency counters of the prior art.

Another object of my invention is to provide an improved currency counter which eliminates the annoying popping noise generated by counters of the prior art.

A further object of my invention is to provide an improved currency counter having a more precise stripper shoe adjustment than do currency counters of the prior art.

Yet another object of my invention is to provide an improved currency counter having a predetermined presettable stripper shoe adjustment.

A still further object of my invention is to provide an improved currency counter having a stripper adjustment which can be operated without removing the cover of the machine.

Other and further objects of my invention will appear from the following description.

BRIEF DESCRIPTION OF THE DRAWINGS

In the accompanying drawings to which reference is made in the instant specification and which are to be read in conjunction therewith and in which like reference numerals are used to indicate like parts in the various views:

FIG. 1 is a fragmentary side elevation of my improved currency counter.

FIG. 2 is a front elevation of the feed rollers, accelerating rollers, and curved guide of the form of my improved currency counter illustrated in FIG. 1.

FIG. 3 is a partially schematic view illustrating one form of drive system which may be used with the form of my improved currency counter illustrated in FIG. 1.

FIG. 4 is an end elevation of the drive system illustrated in FIG. 3.

FIG. 5 is a fragmentary view illustrating the cooperation between the curved guide plate and the upper idler accelerator roller of the form of my improved currency counter illustrated in FIG. 1.

FIG. 6 is a fragmentary top plan of the stripper shoe adjusting system of the form of my improved currency counter illustrated in FIG. 1.

FIG. 7 is a fragmentary front elevation illustrating the stripper shoe adjusting mechanism of the form of my improved currency counter illustrated in FIG. 1.

FIG. 8 is a fragmentary top plan of the form of my improved currency counter illustrated in FIG. 1.

DESCRIPTION OF THE PREFERRED EMBODIMENT

Referring now to FIGS. 1 and 2, my improved currency counter indicated generally by the reference character 10, includes a cabinet 12 provided with a cover 14 which may be opened or removed in any manner known in the art. The apparatus includes an input tray 16 on which a stack of currency notes or the like to be counted are placed. A pair of pickers 18, one of which is shown in the drawings, are carried by a shaft 20 which is driven in a manner to be described to cause the pickers 18 to remove the lowermost sheet in the stack.

Sheets removed from the stack by the pickers 18 are received by feed rolls 22 and 24 carried by a shaft 26 which is driven in a manner to be described to advance the sheets along a curved guide 28 having respective pivot supports 30 and 32 by means of which the guide is pivotally supported in the cabinet 12.

Sheets being advanced along the curved guide by the feed rolls 22 and 24 are received by the nip between an accelerator idler roller 34 supported on a bushing 36 on shaft 26 and a driven accelerator roll 38 carried by a shaft 40.

Shaft 40 is driven in a manner to be described hereinbelow to cause the sheets to be advanced along a stationary guide 42 to stacker wheels 44, one of which is shown carried by a shaft 46.

Referring now to FIGS. 3 and 4, one form of drive system which may be used with my improved currency counter includes a motor 48 driving a shaft 50 carrying a double pulley 52 connected by belts 54 and 56 to a double pulley 58 on the shaft 40 carrying the driven accelerator wheel 38. A smaller gear 60 carried by shaft 40 meshes with a relatively larger gear 62 on the feed wheel shaft 26 to drive the feed wheels 22 and 24.

A pulley 64 on shaft 26 drives a pulley 66 on picker shaft 20 by means of a flat belt 68 to rotate pickers 18.

A pulley 70 on shaft 40 drives a belt 71 to drive a pulley 72 on an idler shaft 74. A smaller diameter pulley 76 on shaft 74 drives a pulley 80 on stacker shaft 46 by means of a belt 78.

It is to be noted that the parts of the drive system just described are so constructed and arranged in a manner known to the art as to drive the various parts of the system at the proper speeds to achieve the desired result of moving the sheets from the input tray 16 through the apparatus so as to be deposited by the stacker wheels 44 on a suitable output tray (not shown).

Referring now to FIGS. 1, 6 and 7, my apparatus including respective stripper supports indicated generally by the reference characters 82 and 84 molded from a suitable synthetic resin. Each of the stripper supports 82 and 84 is formed with an integral resilient arm 86 having a shoe carrier 88 provided with suitable slots or the like for supporting a stripper shoe 90 so that the respective shoes 90 cooperate with the feed wheels 22 and 24 to assure that only one sheet at a time is advanced by the feed wheel 22.

As has been explained hereinabove, in operation of feeders of the prior art, the feed wheels move the sheets in such a way that the sheets tend to follow the guide 28 as they move toward the nip between the accelerating wheels 34 and 38. When they are picked up by the accelerating wheels the sheets are snapped against the feed wheels 22 and 24 with a popping action which is both distracting and annoying, particularly a the speed at which devices of this nature operate.

Referring now to FIGS. 2 and 5, I provide my apparatus with means for inhibiting the popping action just described which occurs as sheets are snapped against the feed wheels in the prior art. More specifically, I provide the guide 23 with a rib 92 located between the two feed rollers 22 and 24 and extending along the feed path over the portion of the guide 28 from the point at which it leaves the nip between the feed wheels 22 and 24 and the strippers 90 and the point at which it is picked up by the accelerating rolls 34 and 38. In order to facilitate the passage of sheets between the idler accelerator roller 34 and the guide 28 while accomplishing the object just described, I provide the idler accelerator roller with a peripheral groove 94 for accommodating the rib 92.

Referring again to FIGS. 1, 6 and 7, each of the stripper supports 82 and 84 is secured to the back of the guide 28 by means of a pair of threaded studs 96 and 98 which are threaded through suitable bores in the supports and into threaded holes in the guide 28. It will of course be appreciated that the ends of the studs do not extend beyond the inner surface of the guideplate 28.

The position of the resilient arm 86 of a support, such as support 84, can be adjusted relative to the rest of the support by means of a set screw 100 which extends through a bore in the support and into engagement with the arm 86.

The supports 82 and 84 have respective heads 102 and 104 which are connected by a bar 106. A rod 108 extending across the housing 12 between sides thereof is formed with a flat 110 to which one end of a latch spring 112 is secured by a screw 114. The other end of the latch spring 112 is hooked over the bar 106 so that the spring normally urges the assembly of the guideplate 28 and supports 82 and 84 to rotate in a clockwise direction around its pivot axis as viewed in FIG. 1.

Rod 108 receives a sleeve 116 for axial movement therealong and for rotary movement therearound. I form sleeve 116 with a cutout 118 which permits the spring 112 to be snapped over the bar 106. Cutout 118 also permits limited lateral movement of sleeve 116 on rod 108.

I form the sleeve 116 with respective tapered cam surfaces 120 and 122 which cooperate with surfaces 124 and 126 on the heads 102 and 104. I so shape surfaces 124 and 126 as to be inclined at the same degree as that to which the surfaces 120 and 122 are tapered, so that the surfaces 124 and 126 contact the cams 120 and 122 along lines of contact.

I form the sleeve 116 with a handle 128 extending radially outwardly from the sleeve. A bore 130 in the handle receives a detent ball 132 which is urged by a spring 134 toward the rod 108. I form the rod 108 with four detent grooves 136a to 136d adapted selectively to be engaged by the ball 132. It will thus be seen that there are four adjusted positions of the sleeve 116 along the rod 108. It will readily be appreciated that each step of adjustment represented by a groove 136 may be a predetermined amount. For example, in one embodiment each step may be 0.004 inch in the radial direction.

Referring now to FIG. 8, preferably we form the cover 14 with an opening 138 through which the handle 128 extends. Moreover, we provide indicia alongside the opening so that the user knows which of the adjusted positions is occupied by the sleeve 108.

In operation of our improved currency counter, bills from a stack placed on the tray 16 are fed by the pickers 18 to the nips between the strippers 90 and the feed rolls 22 and 24. The feed rolls and the strippers cooperate to feed the sheets one at a time along the curved path provided by guide 28 until they reach the nip between accelerator rollers 34 and 38. Owing to the presence of the rib 92, there is no snapping action of the sheets as they are picked up by the accelerator rollers. Moreover, the groove 94 accommodates the rib 92 so that there is no interference with the passage of sheets along the curved guide path.

If for any reason it is desired to change the adjusted position of the stripper shoes 90 relative to the feed rollers 22 and 24, handle 28 is operated to position the sleeve 108 at the desired position. If the user wishes to have this adjustment readily accessible, sleeve 108 can be rotated to a position at which the handle 128 extends outward and through the opening 138. Alternatively, if this adjustment is not to be under the control of the operator, the cover can be removed and the sleeve rotated to a position at which the handle 128 is not accessible as indicated in broken lines in FIG. 1.

Individual adjustment of the respective stripper shoes 90 relative to the carriers 82 and 84 can be accomplished by means of the set screws 100.

It will be seen that I have accomplished the objects of my invention. I have provided an improved currency counter which overcomes the disadvantages of currency counters of the prior art. My counter eliminates the annoying popping action present in operation of counters of the prior art. I provide my counter with a very precise adjustment of the stripper shoes relative to the feed wheels. This adjustment may be readily either made accessible to the operator or not.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for advancing sheets from a stack at an input one at a time to an output including in combination means at said input for holding a stack of said sheets, a feed roller, a stripper forming a first nip with said feed roller, means for feeding sheets from said stack to said first nip, a curved guide, means mounting said curved guide adjacent to said feed roller to form a curved path extending from said first nip toward said output, means for driving said feed roller to move sheets through said first nip and along said path, accelerating means forming a second nip for receiving sheets moving along said path and for advancing sheets toward said output, the distance between said nips being less than the smallest dimension in the direction of said path of any sheet being fed whereby the leading edges of sheets being fed enter said second nip before the trailing edges leave the first nip and means extending along said path from a location relatively adjacent to said first nip toward said output for inhibiting snapping of said sheets against said feed roller as the sheets are picked up by said second nip.

2. Apparatus as in claim 1 in which said inhibiting means in a prominence on said guide.

3. Apparatus as in claim 2 in which said prominence is a rib.

4. Apparatus as in claim 3 in which said rib extends in the direction of said path.

5. Apparatus as in claim 1 in which said accelerating means comprises a pair of rollers forming said second nip adjacent to the end of said curved path remote from said input, said inhibiting means comprising a prominence on said guide, one of said rollers being formed with a depression for accommodating said prominence.

6. Apparatus as in claim 5 in which said one acceleration roller is substantially coaxial with said feed roller.

7. Apparatus as in claim 6 in which said prominence is a rib on said guide extending in the direction of said path and in which said depression is a peripheral groove in said one accelerating roller.

8. Apparatus for advancing sheets from a stack at an input one at a time to an output including in combination means at said input for holding a stack of said sheets, a pair of feed rollers, means mounting said feed rollers in spaced relationship on a common axis, respective strippers forming first nips with said feed rollers, means for feeding sheets from said stack to said first nips, a curved guide, means mounting said curved guide adjacent to said feed rollers to form a curved path extending from said first nips toward said output, means for driving said feed rollers to move sheets through said first nips and along said paths, accelerating means forming a second nip for receiving sheets moving along said path and for advancing sheets towards said output, the distance between said first nips and said second nip being less than the smallest dimension in the direction of said path of any sheet being fed whereby the leading edges of sheets being fed enter said second nip before the trailing edges leave the first nips and means extending along said path from a location relatively adjacent to said first nips toward said output for inhibiting snapping of said sheets against said feed rollers as the sheets are picked up by said second nip.

9. Apparatus as in claim 8 in which said inhibiting means is a rib in said guide at a location between said feed rollers.

10. Apparatus as in claim 9 in which said accelerating means comprises an acceleration roller disposed between said feed rollers.

11. Apparatus as in claim 10 in which said acceleration roller is an idler roller substantially coaxial with said feed rollers.

12. Apparatus as in claim 11 in which said acceleration roller is formed with a circumferentially extending groove for accommodating said rib.

13. In a sheet feeder for advancing sheets one at a time along a path from an input to an output, apparatus including a feed roller mounted for rotation around an axis, a stripper shoe adapted to cooperate with said feed roller to ensure that only one sheet at a time is advanced by said feed roller, means mounting said stripper shoe for movement in a first direction generally transversely of said axis toward and away from said feed roller and means for adjusting the position of said stripper shoe relative to said feed roller, said adjusting means comprising a shiftable member, means mounting said member for shifting movement in a second direction across said path and means responsive to movement of said shiftable member in said second direction for moving said stripper shoe in said first direction.

14. Apparatus as in claim 13 in which said shoe mounting means comprises a support, said adjusting means comprising interengageable means on said shiftable member and said support for adjusting the position of said shoe relative to said feed roller in response to said movement of said member.

15. Apparatus as in claim 14 in which said internegageable means comprise a cam surface on said member and a complementary surface on said support.

16. In a sheet feeder for advancing sheets one at a time along a path from an input to an output apparatus including a feed roller mounted for movement around an axis, a support, a stripper shoe on said support, means mounting said support for movement of said stripper shoe in a direction generally perpendicular to said axis toward and away from said roller, means for biasing said support for movement of said stripper shoe in said direction toward or away from said roller and means acting against said biasing means for adjusting the position of said stripper shoe relative to said roller, said adjusting means comprising a shiftable member, means mounting said member for movement transversely of said path and means responsive to movement of said member transversely of said path for acting against said biasing means to adjust the position of said stripper shoe in said direction relative to said roller.

17. Apparatus as in claim 16 in which adjusting means comprises a cam surface on said member for engaging said support.

18. Apparatus as in claim 17 in which said member is a sleeve and in which said member mounting means is a rod extending transversely of said path.

19. Apparatus as in claim 18 including spaced detents for positioning said sleeve on said rod.

20. Apparatus as in claim 18 including a handle on said member, said sleeve being rotatable on said rod.

21. Apparatus as in claim 16 in which movement of said member provides a primary adjustment of said stripper shoe, said support being formed with a resilient arm for receiving said shoe and means for adjusting the position of said arm relative to said support as a secondary adjustment of said shoe.

22. Apparatus as in claim 20 including a housing for receiving said feed roller and support and adjusting means and a cover on said housing, said cover being provided with an opening through which said handle extends in one position of said sleeve around said rod to permit adjustment of said stripper from outside the housing with the cover on and said cover concealing said handle in another position of said sleeve around said rod to prevent adjustment of said stripper from outside the housing with the cover on.

23. In a sheet feeder for advancing sheets one at a time along a path from an input to an output, apparatus including a pair of feed rollers, means mounting said feed roller in spaced relationship on a common axis, a pair of stripper supports, respective stripper shoes carried by said supports, means mounting said supports for movement of said shoes as a unit toward and away from said feed rollers in a direction generally perpendicular to said axis, means biasing said supports for movement of said shoes toward said feed rollers, means including a member shiftable transversely of said feed path for acting against said biasing means to position said shoes relative to said feed rollers in said direction, transverse shifting of said member concomitantly adjusting the positions of said shoes relative to said feed rollers in said direction and means carried by said supports for individually adjusting the positions of said shoes relative to their respective supports.

24. Apparatus as in claim 23 in which said shiftable member is an elongated member mounted for movement in the direction of its length transversely of said path and in which said means including said shiftable member comprises interengageable cam surfaces on said elongated member and on said supports.

25. Apparatus as in claim 24 including means for releasably holding said elongated member in a number of positions.

26. Apparatus as in claim 23 in which each of said stripper supports comprises an integral resilient arm carrying one of said shoes, said individual adjusting means comprising means for adjusting the position of said resilient arm relative to the rest of said support.

27. Apparatus as in claim 24 in which each of said stripper supports comprises an integral resilient arm carrying one of said shoes, said individual adjusting means comprising means for adjusting the position of said resilient arm relative to the rest of said support.

28. Apparatus for advancing sheets from a stack at an input one at a time along a path to an output including in combination means at said input for holding a stack of said sheets, a feed roller for receiving sheets from said stack, means mounting said feed roller for movement around an axis, a support, a stripper shoe on said support, means mounting said support for movement of said stripper shoe in a direction generally perpendicular to said axis toward and away from said roller, means comprising a member shiftable transversely of said path and means responsive to movement of said shiftable member transversely of said path for moving said support in said direction to adjust the position of said stripper shoe relative to said roller, a curved guide, means mounting said curved guide adjacent to said feed roller to form a curved path extending toward said output, means for driving said feed roller to advance sheets from said stack one at a time past said stripper shoe along said path, acceleration means for receiving sheets advanced along said path by said feed roller and for advancing sheets toward said output and means for inhibiting snapping of said sheets against said feed roller as they are picked up by said accelerating means.

29. Apparatus for advancing sheets from a stack at an input one at a time to an output including in combination means at said input for holding a stack of said sheets, a pair of feed rollers, means mounting said feed rollers in spaced relationship on a common axis at a position to receive sheets from said stack, a pair of stripper supports, respective stripper shoes carried by said supports, means mounting said supports for movement of said shoes as a unit toward and away from said feed rollers in a direction generally perpendicular to said axis, means biasing said supports for movement of said shoes toward said feed rollers, means including a member shiftable transversely of said path for acting against said biasing means to position said shoes relative to said feed rollers in said direction, transverse shifting of said member concomitantly adjusting the positions of said shoes relative to said feed rollers in said direction, means carried by said supports for individually adjusting the positions of said shoes relative to their respective supports, a curved guide, means mounting said curved guide adjacent to said feed rollers to form a curved path extending toward said output location, means for driving said feed rollers to advance sheets form said stack one at a time past said stripper shoes and along said path, a pair of acceleration rollers forming an accelerating nip adjacent to the end of said guide remote from said input location for receiving sheets advanced along said path, one of said acceleration rollers being disposed between said feed rollers, a rib in said guide for inhibiting snapping of said sheets against said feed rollers as they are picked up by said accelerating nip and a peripheral groove in said one acceleration roller for accommodating said nip.

* * * * *

UNITED STATES PATENT AND TRADEMARK OFFICE

CERTIFICATE OF CORRECTION

PATENT NO. : 5,058,875

DATED : October 22, 1991

INVENTOR(S) : Robert M. Stewart

It is certified that error appears in the above-identified patent and that said Letters Patent is hereby corrected as shown below:

Column 5, line 31:

Claim 2, "in" should be --is--.

Signed and Sealed this

Second Day of February, 1993

*Attest:*

STEPHEN G. KUNIN

*Attesting Officer*

*Acting Commissioner of Patents and Trademarks*